US007284546B2

(12) United States Patent
Maki et al.

(10) Patent No.: US 7,284,546 B2
(45) Date of Patent: Oct. 23, 2007

(54) ARCHER'S GLOVE FOR USE WITH A BOW STRING RELEASE

(75) Inventors: Ben Maki, Atlanta, GA (US); Eric Gilmore, Lake Placid, NY (US); Clay White, Atlanta, GA (US)

(73) Assignee: Russell Corporation, Atlanta, GA (US)

( * ) Notice: Subject to any disclaimer, the term of this patent is extended or adjusted under 35 U.S.C. 154(b) by 0 days.

(21) Appl. No.: 10/956,391

(22) Filed: Oct. 1, 2004

(65) Prior Publication Data

US 2005/0081838 A1 Apr. 21, 2005

Related U.S. Application Data

(60) Provisional application No. 60/512,015, filed on Oct. 16, 2003.

(51) Int. Cl.
*F41B 5/16* (2006.01)
*A41D 19/00* (2006.01)

(52) U.S. Cl. ..... 124/35.2; 2/161.5

(58) Field of Classification Search ..... 2/16, 2/20, 159, 161.1, 161.5, 169; 124/35.2
See application file for complete search history.

(56) References Cited

U.S. PATENT DOCUMENTS

| | | | | | |
|---|---|---|---|---|---|
| 1,540,995 | A | * | 6/1925 | Mahn | 2/162 |
| 1,716,221 | A | * | 6/1929 | Fernie | 2/166 |
| 1,922,095 | A | * | 8/1933 | Jones | 2/159 |
| 2,242,318 | A | | 5/1941 | Mosier | |
| 2,270,363 | A | | 1/1942 | Weeber | |
| 2,327,836 | A | * | 8/1943 | Willard | 2/159 |
| 2,555,203 | A | | 5/1951 | Ramsey | |
| 2,702,906 | A | * | 3/1955 | Causse | 2/159 |
| 2,710,970 | A | * | 6/1955 | Kennedy | 2/159 |
| 2,740,968 | A | | 4/1956 | Gardocki | |
| 2,769,179 | A | | 11/1956 | Love | |
| 2,907,047 | A | | 10/1959 | Steinberg | |
| 2,985,885 | A | | 5/1961 | Layer | |
| 3,262,126 | A | | 7/1966 | Price | |
| 4,403,594 | A | | 9/1983 | Todd | |
| 4,458,659 | A | | 7/1984 | Troncoso | |
| 4,905,321 | A | * | 3/1990 | Walunga | 2/161.1 |
| D315,427 | S | | 3/1991 | Lavell | |
| D316,916 | S | | 5/1991 | James | |
| 5,027,439 | A | * | 7/1991 | Spector | 2/20 |
| 5,070,856 | A | | 12/1991 | Plummer | |
| 5,079,776 | A | * | 1/1992 | Crawford | 2/20 |
| 5,323,754 | A | | 6/1994 | Pittman | |
| 5,406,649 | A | * | 4/1995 | Bolembach | 2/158 |
| 5,802,615 | A | * | 9/1998 | Wenk | 2/161.2 |
| 5,845,337 | A | | 12/1998 | Smith | |
| 6,035,443 | A | | 3/2000 | Green | |
| 6,085,355 | A | * | 7/2000 | Chen | 2/161.4 |
| 6,178,553 | B1 | * | 1/2001 | Bolton | 2/18 |
| 6,182,293 | B1 | * | 2/2001 | Mustin | 2/161.1 |
| 6,481,431 | B1 | | 11/2002 | Summers | |
| D468,487 | S | | 1/2003 | Shoemaker | |
| 6,862,744 | B2 | * | 3/2005 | Kuroda et al. | 2/161.1 |
| 6,912,731 | B2 | * | 7/2005 | Cass | 2/161.1 |

* cited by examiner

*Primary Examiner*—John A. Ricci

(57) ABSTRACT

A glove for use in archery with a bow string release mechanism includes a finger section and a base section. The finger section includes a series of finger and thumb sheaths. The base section has an upper edge connected to the finger section and a lower edge defining an opening, and includes a palm portion having a first recession extending from the opening toward the finger section and a back portion opposite said palm portion, the back portion having a second recession extending from the opening toward the finger section. A connecting strap is affixed to the base section proximate the opening, with the connecting strap having a length to extend around the base section and close the first recession for secure and comfortable engagement of the bow string release mechanism.

13 Claims, 3 Drawing Sheets

ARCHER'S GLOVE FOR USE WITH A BOW STRING RELEASE

CROSS REFERENCE TO RELATED APPLICATIONS

This application claims the benefit of U.S. Provisional Patent Application No. 60/512,015, filed Oct. 16, 2003, which is herein incorporated by reference in its entirety.

FIELD OF THE INVENTION

The present invention relates to an archer's glove, and more particularly, to an archer's glove that comfortably secures around bow string release to the archer's wrist while concurrently covering and protecting the archer's hand.

BACKGROUND OF THE INVENTION

Bow string release mechanisms 2, as illustrated in FIG. 1, are commonly used by archers to assist in the use of a bow in target shooting and in hunting. The bow string release mechanism 2 provides a uniform release of the bow string and increases the accuracy of the arrow with respect to the target. Conventional forms of bow string release mechanisms 2 are hand-held or strapped to the archer's wrist 1, and they include a trigger which permits the archer to engage and release the string without the archer having to directly contact the string with the archer's fingers. Those devices that are strapped to the archer's wrist typically include a wrist strap 4 that extends or is buckled around the user's wrist. A release head 6 is connected to the wrist strap 4, with the release head 6 having engagement members that are controlled by the trigger to engage and release the bow string.

BRIEF SUMMARY OF THE INVENTION

The present invention provides a glove for use in archery in conjunction with a bow string release mechanism. As discussed above, conventional bow string release mechanisms have a wristband with a head member connected thereto, such that the head member is able to engage the bow string. The glove of the present invention includes a finger section and a base section having an opening. The base section includes a palm portion and a back portion opposite said palm portion. The palm portion includes a palm recession extending from the opening of the glove toward the finger section, with the palm recession substantially surrounding the head member of the bow string release when placed on the archer's hand. The back portion may also include a back recession, wherein the back recession allows a buckle of the wristband to pass through the glove. Finally, the glove additionally includes a connecting strap affixed to the base section proximate the opening of the glove. The connecting strap has a length to extend around said base section and close the palm recession, such that the glove will completely and securely surround the head member of the bow string release mechanism.

BRIEF DESCRIPTION OF THE DRAWINGS

An apparatus embodying the features of the present invention is depicted in the accompanying drawings, which form a portion of this disclosure, wherein.

DETAILED DESCRIPTION OF THE INVENTION

Figure 1:
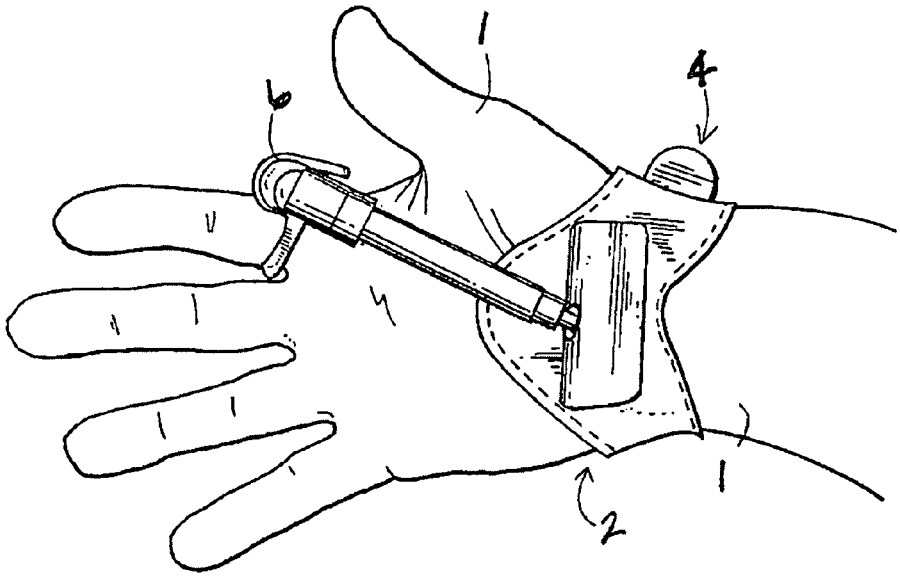
Fig 1 PRIOR ART
FIG. 1 is a plan view of a bow string release mechanism known in the art.
Figure 2:
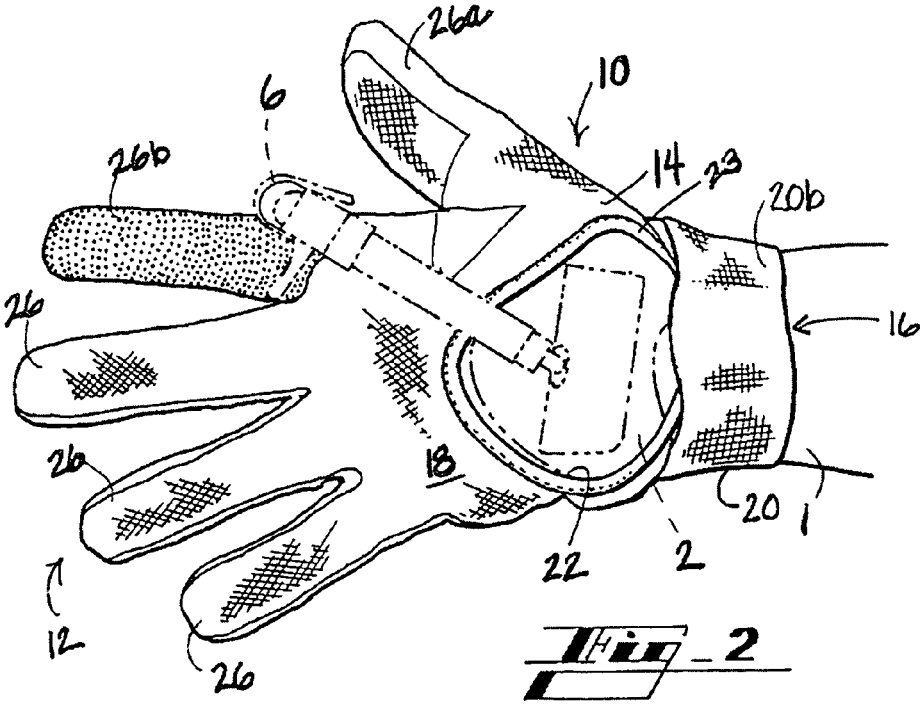
FIG. 2 is a plan view of a bow string release glove of the present invention.
Figure 4:
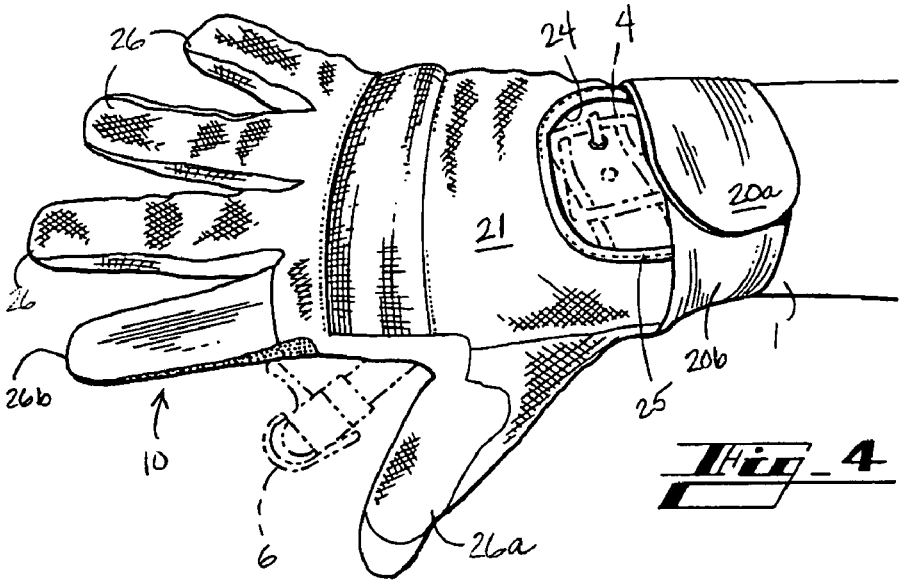
FIG. 4 is a back perspective view of the bow string release glove of the present invention with a user's hand illustrated in phantom.

Looking to FIGS. 2 and 4, the present invention is a bow string release glove 10 worn on an archer's hand 1, which works in tandem with a bow string release mechanism 2 that is used when shooting an arrow (not illustrated) from a modern compound bow (not illustrated). The glove 10 includes a finger section 12 and a base section 14. The finger section 12 includes four finger sheaths 26 (including a forefinger sheath 26*b*) and a thumb sheath 26*a*. The base section 14 has an upper edge and a lower edge, with the finger section 12 being connected with the upper edge of the base section 14 and the lower edge of the base section 14 defining an opening 16 to receive the archer's hand 1. The glove 10 additionally includes an adjustable wristband 20 or securing strap attached to the base section 14, with a hook and loop type closure 28*a*, 28*b* affixed to the adjustable wristband 20. The wristband 20 is therefore able to securely engage the archer's wrist 1 with a pressure as desired by the archer, without concern for the size of the archer's wrist or personal preferences as to the comfort of the glove 10.

Figure 5:
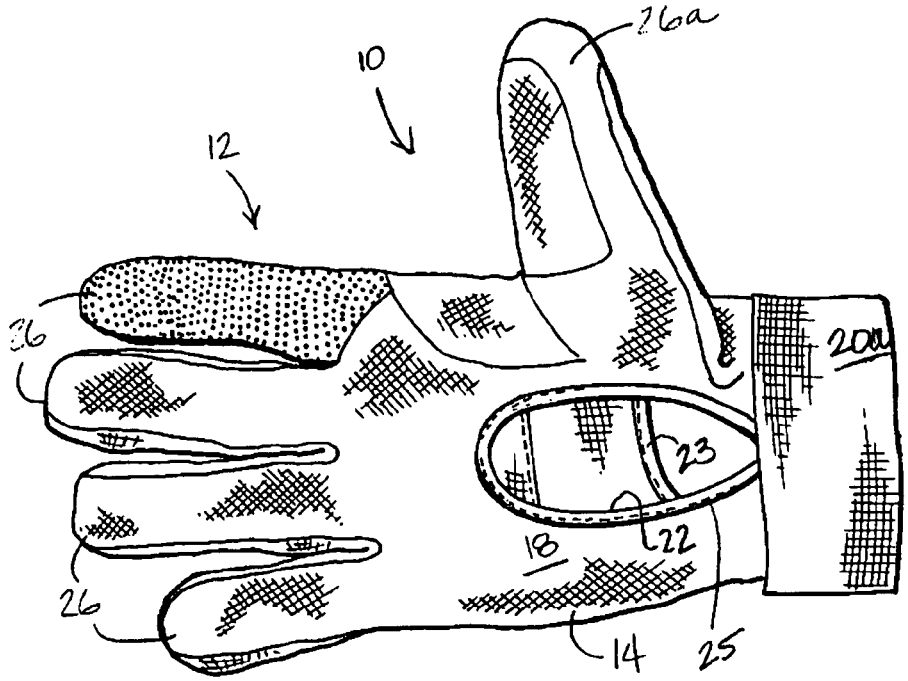
FIG. 5 is a palm perspective view of the bow string release glove of the present invention having a wristband in a closed position.
Figure 6:
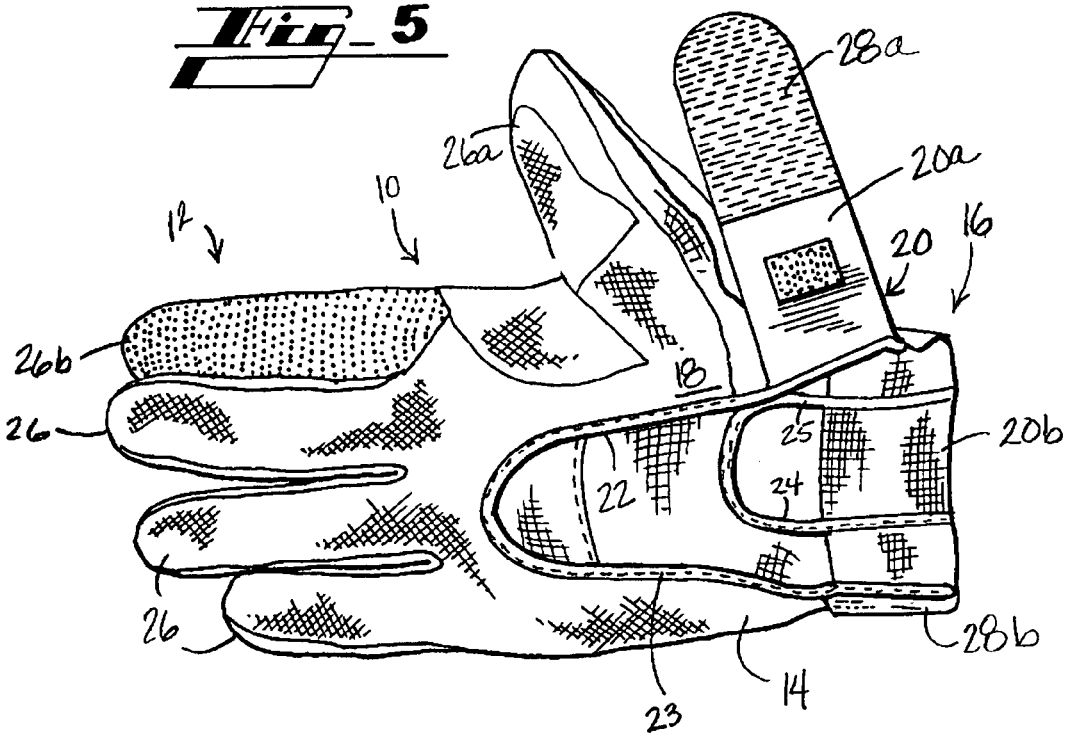
FIG. 6 is a palm perspective view of the bow string release glove of the present invention having a wristband in an opened position.

Looking to FIGS. 2, 5 and 6, the base portion 14 of the glove 10 includes a palm portion 18 having a palm or first recession 22 extending from the opening 16 of the glove 10 toward the finger section 12. The palm recession 22 of the glove 10 may have an oval or circular shape as desired by the archer to complement the shape of the bow string release mechanism 2. The palm recession 22 is additionally lined with a palm top stitch 23. The palm recession 22 of the glove 10 provides a pass-through for the head member 6 of the mechanical bow string release mechanism 2 used in archery.

Figure 3:
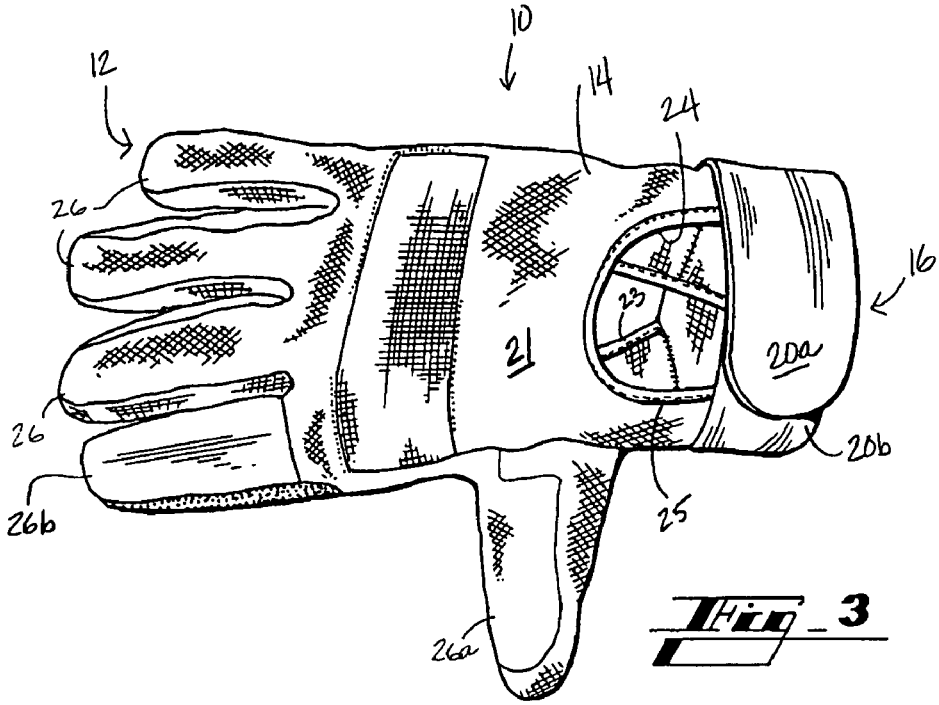
FIG. 3 is a back perspective view of the bow string release glove of the present invention.

Looking to FIGS. 3 and 4, the base section 14 of the glove 10 additionally includes a back portion 21 opposite the palm portion 18 extending from the opening 16 toward said finger section 12. The back portion 21 includes an outer or second recession 24 that extends from the wristband 20 toward said finger section 12, the wrist clasp 4 extending through said second recession and a rear side rectangular-shaped cut-away forehand portion. The outer recession 24 is lined with an outer top stitch 25.

Continuing to view FIG. 6, the adjustable wristband 20 includes a connecting strap 20*a* and a base strap 20*b* proximate the opening 16 of the glove 10. The connecting strap 20*a* has a length to extend around said base strap 20*b* to engage the base strap 20*b* (see FIGS. 3 and 4). The connecting strap 20*a* is able to thereby close the palm recession 22 around the bow string release mechanism 2, wherein the head member 6 of the bow string release mechanism 2 may extend through said palm recession 22 and securely reinforce the position of the bow string release mechanism 2 on the archer's hand 1.

In operation, prior to adorning the glove 10, the archer will strap and buckle the bow string release mechanism 2 to the archer's wrist 1, such that the head member 6 is positioned proximate the archer's hand 1. The archer will then insert his hand into the glove 10, such that the archer's fingers and thumb will enter the finger sheaths 26 and thumb sheath 26*a*, respectively. At the same time, the head member 6 of the bow string release mechanism 2 will traverse the palm recession 22 of the glove 10, while the adjustable buckle 4 or clasp will traverse the outer recession 24 of the glove 10. Once the archer's hand 1 fully engages the glove 10 and bow string release mechanism 2, the archer will be able to close the area surrounding the head member 6 by drawing the connecting strap 20*a* around the archer's wrist to be affixed to the base strap 20*b*, such as by hook and loop material 28*a*, 28*b* (or any other known method for connecting such cloth members). The archer will be able to adjust the position of the connecting strap 20*a* so that the glove 10 is firmly affixed to the archer's hand 1 without being excessively tight, and this connection will additionally help secure the position of the bow string release mechanism 2.

In addition, the glove 10 itself may be made of a stretchable polyester-knit fabric strip stitched to the front side hand portion thereof, just below the finger portion and above the cut-away forehand portion. The glove 10 is worn to conceal and protect the archer's hand 1 when hunting game. Therefore, the fabric of the glove 10 is printed with a design pattern, such as camouflage pattern. The finger sheaths 26 and the thumb sheath 26*b* on the glove 10 may include a stretchable fabric combined with leather or other flexible material. The stretchable fabric construction of the glove 10 allows freedom of movement, comfort and flexibility for the wearer. Moreover, referring to FIG. 2, the forefinger sheath 26*b* may include a skin-sensitive material providing additional comfort and sensitivity for the archer, such as pressed leather.

As can be seen in FIGS. 2 and 4, the glove 10 provides cut-away portions to allow the bow string release mechanism 2 to pass through the glove 10 without interfering with the fit of the glove 10 or the function of the bow string release mechanism. A traditional archer's glove does not have cut-away portions, much less adjustable recessions to conform with the size of the archer's hand 1 and the bow string release mechanism 2, and therefore is uncomfortable for the archer. Furthermore, with traditional archer's gloves, the bow string release mechanism 2 will cause the glove to bunch up and slide off the wearers hand.

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. A glove for use in archery with a bow string release mechanism, the bow string release mechanism having a wrist clasp and a head member, wherein said glove comprises:

a finger section and a base section having an opening, said finger section connected to said base section opposite said opening, said finger section including five sheaths, at least one of said sheaths comprising a skin-sensitive material, wherein said base section further includes:

a palm portion having a first recession extending from said opening toward said finger section; and a back portion opposite said palm portion; and a connecting strap affixed to said base section proximate said opening, said connecting strap having a length to extend around said base section to define a head member opening in said first recession;

wherein the head member of the bow string release mechanism may extend through said head member opening of said first recession.

2. The glove as described in claim 1, further comprising a second recession in said back portion extending from said opening toward said finger section, the wrist clasp extending through said second recession.

3. The glove as described in claim 1, wherein said skin-sensitive material comprises pressed leather.

4. The glove as described in claim 1 further comprising connecting means for fastening said connecting strap around said base portion.

5. The glove as described in claim 4, wherein said connecting means comprises hook and loop material.

6. In a glove having a base portion and a finger portion, the base portion having a palm portion and a back portion, the base portion further having an upper edge and a bottom edge, the finger portion being connected to the upper edge of the base portion, an improvement for securing a bow string release mechanism to a user's hand comprising:

an interior recession in said palm portion of said glove extending from the bottom edge of the base portion toward the upper edge of the base portion;

an outer recession in said back portion of said glove extending from the bottom edge of the base portion to the upper edge of the base portion; and a securing strap connected to said base portion proximate the bottom edge of said base portion, said securing strap spanning the palm portion and back portion of said improved glove to enclose the bow string release mechanism in said interior recession;

wherein the finger portion includes five coverings, at least one of said coverings comprising a skin-sensitive material.

7. The improved glove as described in claim 6, wherein said skin-sensitive material provides comfort and sensitivity for a finger of the user's hand.

8. The improved glove as described in claim 6 wherein said skin-sensitive material comprises pressed leather.

9. The improved glove as described in claim 6 further comprising connecting means for fastening said connecting strap around said base portion.

10. The improved glove as described in claim 9, wherein said connecting means comprises hook and loop material.

11. A method for securing and camouflaging an archer's hand while concomitantly securing a bow string release mechanism to the archer's hand, said method comprising the steps of:

a. attaching the bow string release mechanism to the archer's hand, the bow string release mechanism having a head member proximate the palm of the archer's hand and a fastener proximate the back of the archer's hand;

b. sliding a glove onto the archer's hand, said glove having a palm portion and a back portion;

c. surrounding the head member of the bow string release mechanism with a first recession in said palm portion of the archer's glove; and d. wrapping a strap around said base portion of the archer's glove to secure the position of said glove around said bow string release mechanism.

12. The method as described in claim 11, wherein step c) further comprises the step of:

surrounding the fastener of the bow string release mechanism with a second recession in said back portion of the archer's glove.

13. The method as described in claim 11 wherein said step d) further comprises:

surrounding the fastener of the bow string release mechanism with a second recession in said back portion of the archer's glove; and affixing said strap to said base portion of said glove.

* * * * *